US012135189B2

(12) United States Patent
Jones

(10) Patent No.: US 12,135,189 B2
(45) Date of Patent: Nov. 5, 2024

(54) ARCHERY BOW SIGHT

(71) Applicant: H.I.T. Outdoors, LLC, Clay City, KY (US)

(72) Inventor: Brian K. Jones, Clay City, KY (US)

(73) Assignee: H.I.T. Outdoors, LLC, Clay City, KY (US)

( * ) Notice: Subject to any disclaimer, the term of this patent is extended or adjusted under 35 U.S.C. 154(b) by 46 days.

(21) Appl. No.: 18/103,103

(22) Filed: Jan. 30, 2023

(65) Prior Publication Data

US 2024/0255255 A1 Aug. 1, 2024

(51) Int. Cl.
*F41G 1/467* (2006.01)
*F41B 5/14* (2006.01)

(52) U.S. Cl.
CPC ..... *F41G 1/467* (2013.01); *F41B 5/14* (2013.01)

(58) Field of Classification Search
CPC ..... F41G 1/467; F41B 5/14
USPC ..... 124/80, 87, 88; 33/265
See application file for complete search history.

(56) References Cited

U.S. PATENT DOCUMENTS 4,136,462 A 1/1979 Topel
4,263,718 A 4/1981 Smith
4,462,163 A 7/1984 Tentler
4,535,747 A 8/1985 Kudlacek
4,689,887 A 9/1987 Colvin
4,875,290 A * 10/1989 Finch ..... F41G 1/467 42/137
4,884,347 A 12/1989 Larson
5,131,153 A 7/1992 Seales
5,239,760 A 8/1993 Dixon et al.
5,507,272 A 4/1996 Scantlen
5,638,604 A 6/1997 LoRocco
5,946,812 A * 9/1999 Slates ..... F41G 1/467 124/87
6,000,141 A 12/1999 Afshari
6,073,352 A 6/2000 Zykan et al.
6,968,837 B1 11/2005 Shepley
7,574,810 B1 * 8/2009 LoRocco ..... F41G 1/44 124/87
7,900,365 B1 * 3/2011 Johnson ..... F41G 1/467 33/265
7,997,261 B2 8/2011 Scaniffe
8,640,349 B2 2/2014 Wasilewski
8,689,454 B2 4/2014 Pulkrabek et al.
10,190,851 B1 * 1/2019 Hamm ..... F41G 1/467
10,907,933 B1 * 2/2021 Hamm ..... F41G 1/467
2003/0110647 A1 * 6/2003 Henry ..... F41G 1/467 124/87

(Continued)

*Primary Examiner* — John E Simms, Jr.
(74) *Attorney, Agent, or Firm* — Warner Norcross + Judd LLP

(57) ABSTRACT

An archery bow sight is provided including an adjuster having a homing pin indexed within a homing slot to prevent a sight housing from free spinning with a round elongated arm in a round arm hole of the adjuster when the adjuster is operated by a user to move the sight housing relative to a mounting bracket. The adjuster can include a dial that interacts with threads on the elongated arm, which can cover a large portion of the arm and provide additional adjustability. The adjuster can include an adjustment control having a shaft that engages the homing pin forcibly with the homing slot and arm to lock the arm in a fixed position relative to the bracket in a lock mode. A related method of use is also provided.

17 Claims, 4 Drawing Sheets

(56) References Cited

U.S. PATENT DOCUMENTS

| | | | | |
|---|---|---|---|---|
| 2003/0177651 | A1 | 9/2003 | Stone | |
| 2010/0018513 | A1* | 1/2010 | Scaniffe | F41G 1/44 124/87 |
| 2011/0072672 | A1* | 3/2011 | Hoffman | F41G 1/467 33/265 |
| 2012/0325194 | A1 | 12/2012 | LoRocco | |
| 2015/0135579 | A1* | 5/2015 | Summers | F41G 1/467 42/130 |
| 2018/0045488 | A1* | 2/2018 | Hamm | F41G 1/40 |
| 2021/0325148 | A1* | 10/2021 | Jones | F41G 1/467 |

* cited by examiner

ARCHERY BOW SIGHT

BACKGROUND OF THE INVENTION

The present invention relates to archery sights, and in particular, to archery sights having a wide range of adjustability yet smooth and reliable adjustment controls.

Most conventional archery bows are outfitted with sights that are designed to align the trajectory of an arrow shot from the bow with a target or game. These bow sights include sight pins to be aligned with the target for accurate shooting. Archers or bow hunters often desire to shoot targets or game at different distances. Accordingly, most bow sights include multiple sight pins, each calibrated for a target at a different range. Depending on the target range, the archer must select the corresponding sight pin and align it with the target. If the archer's range estimation, pin selection and indicia alignment are correct when the archer shoots the arrow, the arrow will hit the target.

To provide a desired accuracy, a bow sight must be properly calibrated and positioned relative to a bow riser and to an arrow rest which supports an arrow. In particular, the individual sight pins are precisely positioned at both a vertical distance and a horizontal distance from these elements to establish a desired trajectory of the arrow and its point of impact with a target. Most conventional bow sights therefore include both vertical and horizontal sight adjusters attached to one or more arms, which are further attached to the riser of the bow. These adjusters frequently include a rectangular bar slidably disposed in a rectangular hole defined by the arm. The arm also includes a slot that extends to the rectangular hole, with a fastener traversing the slot. The fastener can be tightened to close the slot and reduce the dimensions of the rectangular hole, thereby clamping the rectangular bar within the rectangular hole.

While this rectangular bar in hole provides consistent registration and alignment, it suffers some shortcomings. For example, if the bar and hole are not closely and precisely dimensioned, there can be some excess wobble in the adjuster when it is being adjusted, which can make macro adjustments more tedious. Further, sometimes the rectangular bar can be partially threaded at the outer corners to provide adjustment. However, those threads at the corners require extra machining, and thus increase manufacturing costs. In addition, only part of the rectangular bar can be threaded at the corners, so that reduces the amount of adjustment that can be made to the bar, and the sight pins adjustment range as a result.

Accordingly, there remains room for improvement in connection with adjustment mechanisms for archery bow sights to provide consistent positioning, orientation and homing of sight pins and/or a sight housing of such sights.

SUMMARY OF THE INVENTION

An archery bow sight is provided including an adjuster having a homing pin indexed within a homing slot to prevent a sight housing from free spinning with an elongated arm disposed in an arm hole of the adjuster when the adjuster is operated by a user to move the sight housing relative to a mounting bracket.

In one embodiment, the elongated arm can be round and the arm hole can be round. The arm can be substantially cylindrical, and the arm hole can be circular or cylindrical, which in some cases can facilitate manufacture of these components. The arm hole also can be bounded by a perimeter of material.

In another embodiment, the adjuster is a windage adjuster and can include an adjustment control extending through a portion of the windage adjuster and operable in a lock mode. In the lock mode, the adjustment control engages the homing pin with the homing slot to prevent the elongated arm from sliding within the round arm hole, for example, when sight indicia within the sight housing has been properly set.

In still another embodiment, the adjustment control can include a knob and a shaft. The shaft can engage the homing pin forcibly with the homing slot and arm to lock the arm in a fixed position relative to the bracket in a lock mode.

In yet another embodiment, the perimeter can define a shaft hole that is coextensive with the round arm hole. The shaft can project through the shaft hole, optionally into the round arm hole or a perimeter slot, and can forcibly engage the homing pin in the lock mode. In the lock mode, the homing pin can press against the elongated arm within the homing slot, to secure the arm in a fixed position relative to the hole.

In even another embodiment, the adjuster can include a dial that interacts with threads on the elongated arm, which threads can cover a large portion of the arm and provide additional adjustability. Rotation of the dial can incrementally move the arm and thus the sight housing and sight indicia to the preference of the user.

The archery bow sight of the current embodiment provides an adjuster that is smooth, yet precise, and that still maintains a consistent home position of the sight housing and sight indicia throughout adjustment. Where the hole and arm are round, the adjuster can be quickly and easily machined, which can reduce machine wear and can reduce the amount of labor costs and manufacturing time to produce the bow sight. Where the arm is round, more of it can be threaded, which in turn can provide a greater range of adjustment to fit a greater number of archery bows having different configurations.

These and other objects, advantages, and features of the invention will be more fully understood and appreciated by reference to the description of the current embodiments and the drawings.

DETAILED DESCRIPTION OF THE INVENTION

Figure 1:
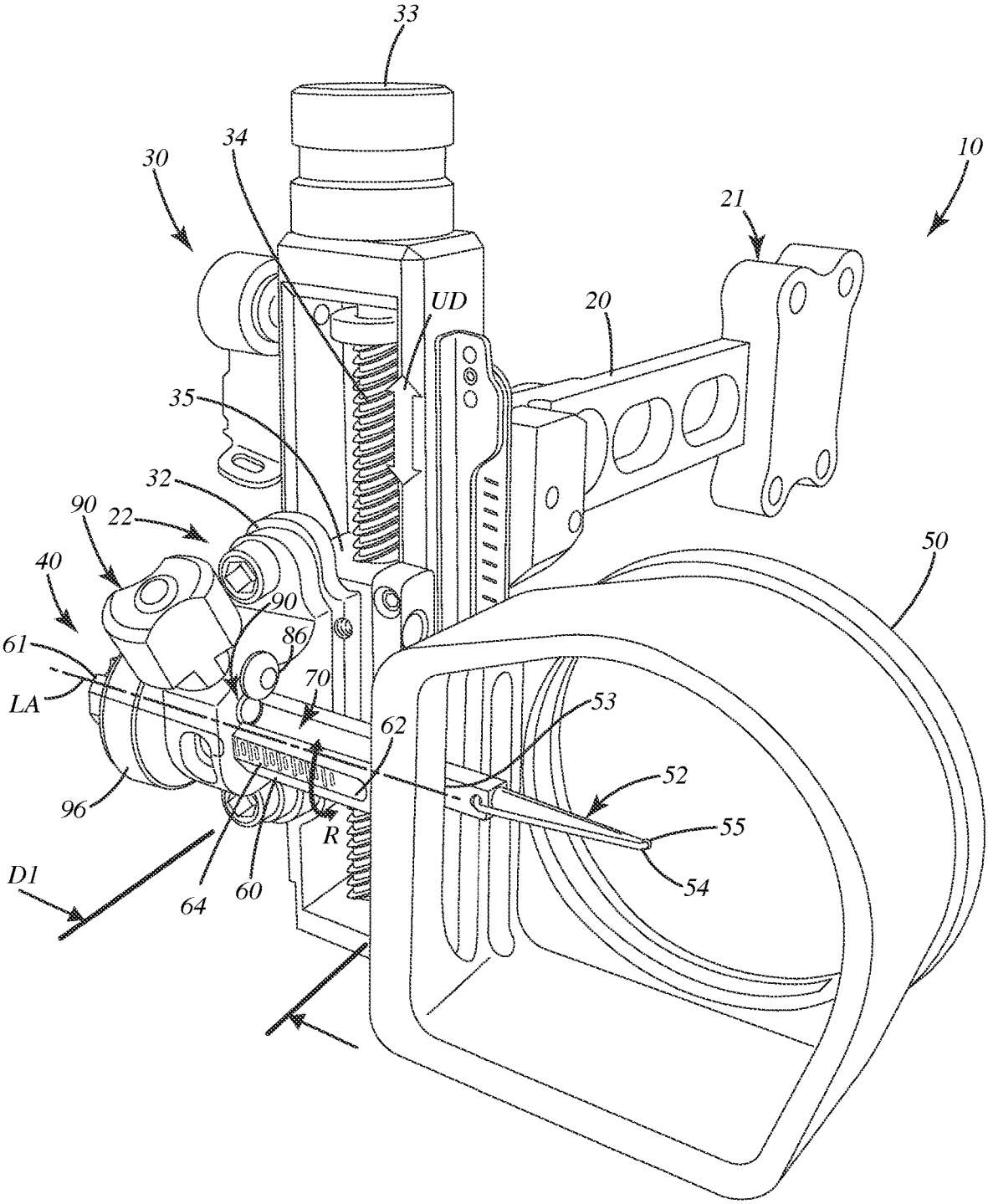
FIG. 1 is a perspective view of a current embodiment of the archery bow sight joined.

An archery bow sight constructed in accordance with an embodiment of the invention is illustrated in FIGS. 1-4 and generally designated 10. The sight 10 can include a mounting bracket 20 and an adjuster 40. The mounting bracket 20 can have one or more holes, or can be of a particular shape, to be fastened or otherwise secured to a riser of an archery bow. For purposes of this disclosure, the bow sight is described in connection with its use on an archery bow, however, the construction is well suited for use with any projectile shooting device. Optionally, the mounting bracket can be an elongated bar configured for insertion into part of a riser and securement thereto with a clamp or other fastening mechanism.

The mounting bracket 20 can include a proximal end 21 that joins with an archery bow riser, and a distal end 22 that projects forwardly of the proximal end and is configured to extend forwardly of an archery bow riser when the bow sight 10 is mounted to the bow riser. The adjuster 40 can be joined with this distal end 22 of the mounting bracket. The adjuster 40 is shown as a windage adjuster configured to adjust the side to side or lateral distance D1 of the sight housing 50 from the bracket 20 and generally from some portion of the archery bow to which the sight 10 is connected. Optionally, the adjuster 40 can be joined with a mounting block 32 of another adjuster 30, which optionally can be an elevation adjuster, configured to adjust the vertical disposition of the sight housing 50 and any sight indicia 55 associated with the housing. The elevation adjuster 30 can include a control knob 33 which can rotate a threaded shaft 34, which is further connected to a carrier 35 joined with the mounting block 32 upon which the other adjuster 40 is mounted. By rotating the control knob 33, the shaft 34 rotates, and that rotation translates to linear motion of the carrier 35, which also can be threaded corresponding to the shaft 34, and thus to linear motion of the mounting block 32. As a result, the vertical adjuster 30 can move the windage adjuster 40 in directions UD up or down. Although a particular vertical adjuster 30 is shown, other types of vertical adjusters can be substituted for use with the current sight 10. Further, although not shown, the vertical adjuster can be provided in the sight housing 50 to move the respective sight indicia 55. Further optionally, in some limited applications, the vertical adjuster can be absent from the sight.

Figure 2:
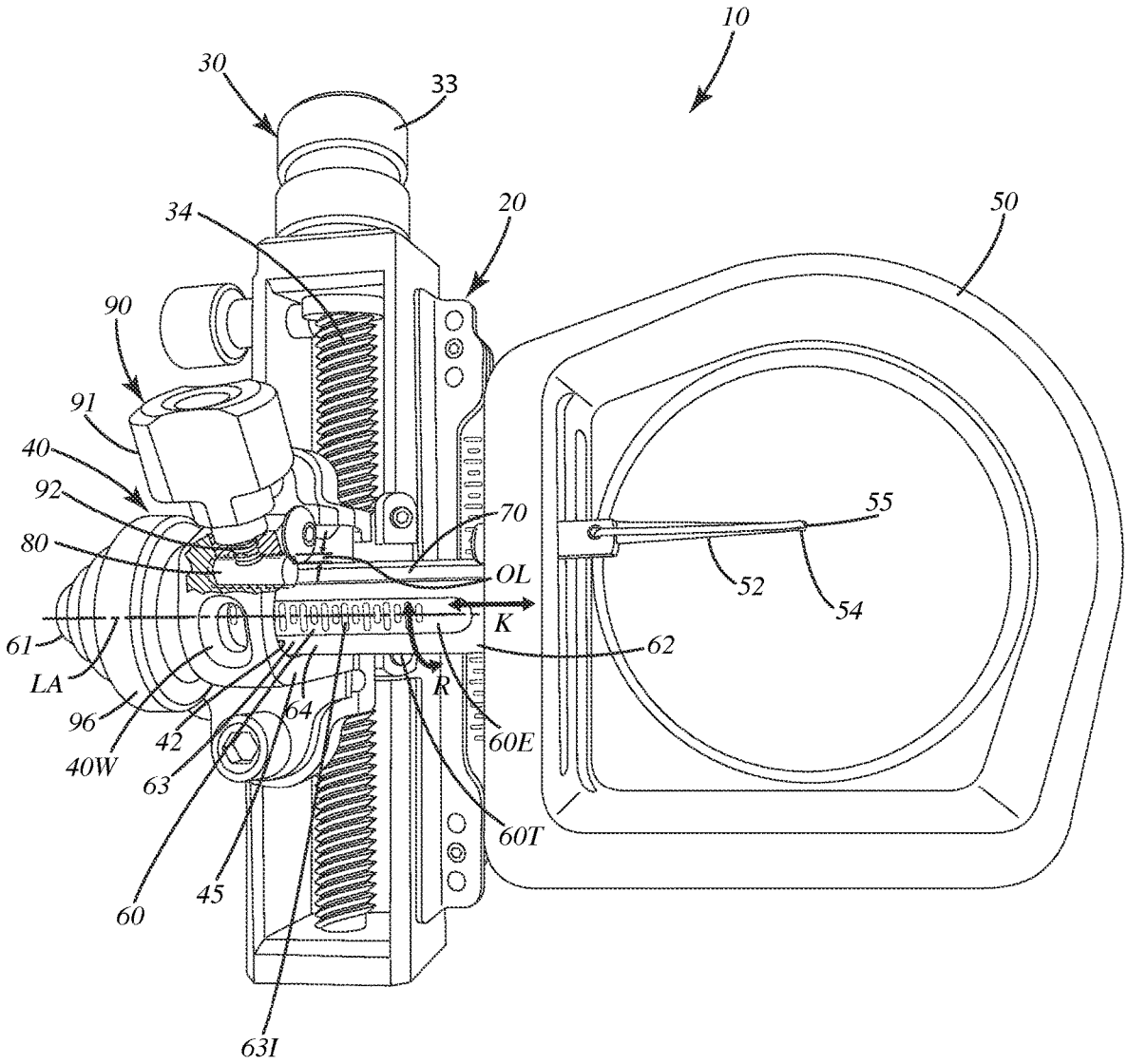
FIG. 2 is a front partial section view of an adjuster of the bow sight illustrating an adjuster having a homing pin in a homing slot of an elongated arm supporting a sight housing with a sight indicia.
Figure 3:
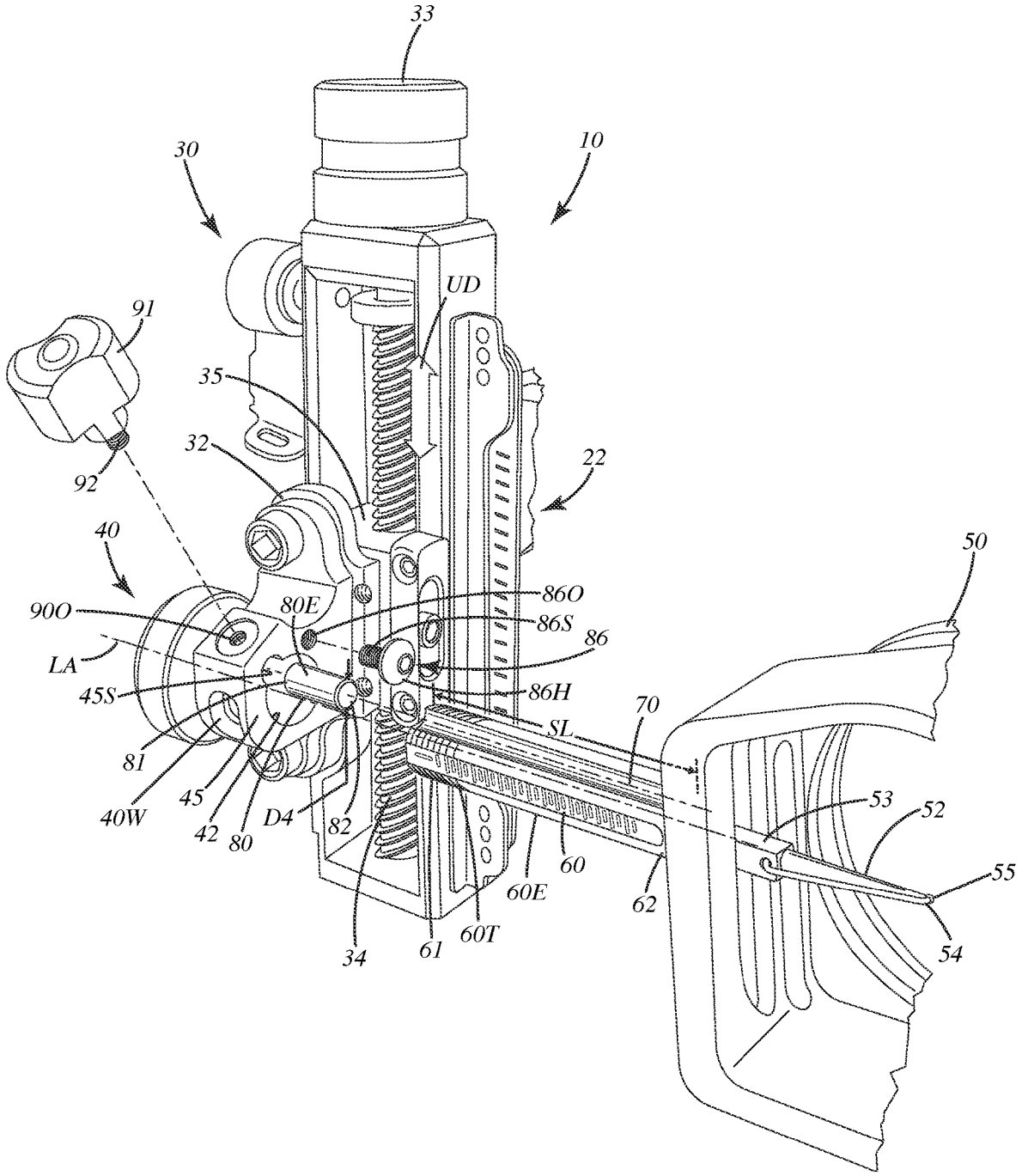
FIG. 3 is an exploded view of the bow sight illustrating an adjustment control, the homing pin and the homing slot defined by the elongated arm.
Figure 4:
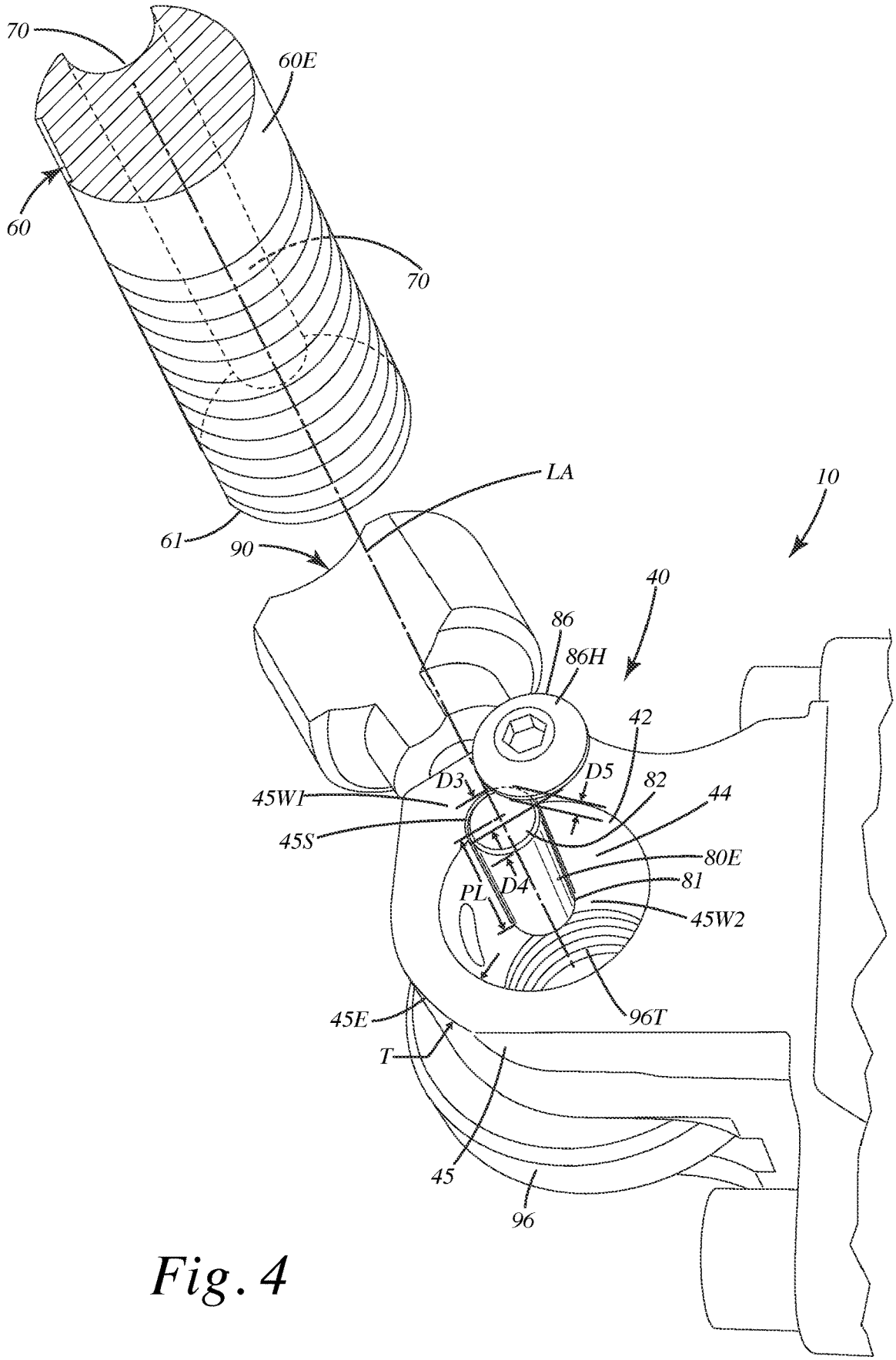
FIG. 4 is a lower perspective view of the bow sight, illustrating the homing pin in a perimeter slot secured in the adjuster with a capture fastener.

As shown in FIGS. 2-4, the windage adjuster 40 can define an arm hole 42 which is configured to receive an elongated arm or bar 60 that also forms part of the adjuster 40. As shown and described below, the arm hole 42 can be a round arm hole, and the elongated arm 60 can be a round elongated arm that interfits within the round arm hole, and which can be prone to rotating or spinning freely in that round arm hole, without the homing or indexing elements described herein. The elongated arm 60 can extend to and can be joined with the sight housing 50. In particular, the elongated arm 60 can include a first end 61 and a second end 62 with an intermediate portion 63 disposed therebetween. The sight housing 50 can be joined with the second end 62 of the elongated arm, distal from the mounting bracket 20.

The sight housing 50 can be a rigid element that protects and/or surrounds one or more sight pins 52. Although only one sight pin is shown, additional sight pins can be included in the sight housing and the number can vary, depending on the number of ranges that the bow sight is designed to accommodate. As shown in FIG. 2, each sight pin 52 can include a first end 53, which is proximal to a wall of the sight housing. Although referred to as "pins", a sight pin can be of any cross section, for example, circular, rectangular, triangular, elliptical and the like, and can be of variable cross sections along their lengths. The sight pin 52 can also include a second end 54, distal from the first end, which can include a sight indicia 55. This sight indicia can be any point or indicia of any type that is visually placed in line with a target for assisting in the proper aiming of the bow. Sight indicia can be of any shape, for example, circular, diamond, square, and other geometrical shapes. Moreover, the sight indicia can be formed as colored dots, the end of a light gathering filament, or simply the end of the sight pin. As shown, however, the sight indicia can be formed by the ends of fiber optic filaments, which collect light along its length, with the collected light exiting the end of the filament. The length of the fiber optic can be secured in a conventional manner to the sight element. The end of the fiber optic filament forming the sight indicia can be located in a hole defined in the second end 54 of the element. Alternatively, the hole may be absent, and the fiber optic filament can be adhered or crimped or otherwise fastened to the second end as desired. Further optionally, the fiber optic filament can be replaced entirely with a vile, bulb or tube (not shown) containing a light emitting substance, such as tritium and/or phosphor. The tube can be secured in the hole much like the fiber optic filament to provide a sight indicia for an archer. Alternatively, the entire sight element can be constructed from light gathering and transmitting material. Yet further optionally, the sight pin 52 can be vertically adjustable within the sight housing 50 using any conventional mechanism.

Returning now to the windage adjuster 40 and its components as shown in FIGS. 1-4, that assembly can be designed for easy manufacture, smooth operation and the ability to maintain a consistent orientation of the sight housing 50 and its sight indicia 55 relative to the mounting bracket 20 and the archery bow to which the sight is attached. As mentioned above, the windage adjuster can include a round elongated arm 60. This round elongated arm 60 can include a first end 61, a second end 62 and an intermediate portion 64 therebetween. The elongated arm can again be of a round configuration. For example, the arm can be cylindrical. As used herein, the arm can be cylindrical even though it can include one or more flat or planar faces or lands 63 around the circumference of a particular cross section. The arm at such a flat face or land can include one or more indicia elements 631, which as shown can be in the form of multiple different length lines disposed along the land 63 at consistently spaced locations. These elements can be of any aesthetic configuration. As shown, the indicia elements can be laser etched on the bracket. Of course, in other cases they can be notches or lines painted, coated or otherwise applied to the arm 60. These indicia elements 631 can be visible through a window 40W defined in a forward portion of the adjuster 40. By registering particular indicia 631 in that window 40W, a user can consistently calibrate the distance D1 by which the sight housing and associated sight pins are offset relative to the mounting bracket and thus the riser and other components of an archery bow to which the sight 10 is mounted. The window 40W can be of an elliptical shape, but of course can be of polygonal or other shapes or slots depending on the application and the indicia 631 that are viewed through the window.

The elongated arm 60 can include a longitudinal axis LA extending between the first end 61 and the second end 62. As mentioned above, the elongated arm 60 can include an exterior surface 60E. This exterior surface 60E or a portion of the arm 60 can define a homing slot 70 extending within the intermediate portion 64 of the arm. This homing slot as illustrated can be in the form of a recess defined by an upper portion of the elongated arm 60. This homing slot 70 can be of any length, but as shown can extend across the intermediate portion 64, generally from the first end 61 to the second end 62 of the elongated arm, optionally stopping short of the edge of the second end 62 so that the sight housing does not collide with the windage adjuster 40 upon extreme adjustment thereof. The homing slot 70 can be of a partially circular cross section or of a partially cylindrical shape that extends inward from the exterior surface 60E of the elongated arm 60. Of course, in other applications, the homing slot can be a polygonal shape or other shapes depending on the construction of the homing pin 80 as described below.

As shown in FIGS. 1 and 4, the windage adjuster 40 can include a homing pin 80 that is indexed with the homing slot 70, optionally extending at least partially within the homing slot. Generally, the indexing of the homing pin 80 within the homing slot 70 impairs or prevents the elongated arm 60 from rotating within the arm hole 42 defined by the adjuster 40. In turn, this prevents the sight housing and the sight indicia from free spinning with that elongated arm within the armhole 42 about the longitudinal axis LA of the armhole and or the elongated arm 60. As a result, the sight housing 50 and the sight indicia 55 maintain a consistent orientation relative to the mounting bracket 20 in the archery bow to which the mounting bracket is attached, and generally do not rotate in directions R shown in FIG. 2. This consistent orientation is maintained when the windage adjuster is in a lock mode as described below and/or in a adjustment mode in which the windage adjuster is being operated by a user to adjust the lateral distance D1 of the sight housing and sight indicia relative to the mounting bracket and the archery bow.

Turning now with more particularity to FIGS. 2 and 4, the homing pin 80 can include a first end 81 and a second end 82. The homing pin 80 can be of a substantially cylindrical shape between those ends, and can include a diameter D4. The homing pin 80 can be constructed from a metal, such as a brass or alloy, or alternatively from a composite or a durable polymer. The homing pin 80 can include a homing pin length PL. This homing pin length PL can be less than a homing slot length SL as shown in FIG. 3. This is so that the homing pin 80 can track within the homing slot 70 over the length SL of that homing slot.

As shown in FIG. 4, the round arm hole 42 of the windage adjuster 40 can be bounded by a perimeter 44. This perimeter 44 can be of a substantially cylindrical shape and generally can be uninterrupted by any voids that extend through the thickness T of the adjuster base 45 from the perimeter 44 to the exterior 45E of the base 45 to provide a clamping function. Of course, there can be a small hole 90O to receive a threaded shaft of the adjustment control 90 as described below. The round arm hole 40 can correspond to the round exterior surface 60E of the elongated arm 60, which again can be a round elongated arm.

The perimeter 44 optionally can be interrupted by a perimeter slot 44S that is defined by that perimeter, also referred to as a perimeter wall. The perimeter slot can be of a corresponding shape and cross section to receive the homing pin 80 therein. For example, the perimeter slot can be partially cylindrical, to receive part of a corresponding cylindrical exterior surface of the homing pin 80 therein. Generally, the tolerance between the walls of the perimeter slot 44S and the exterior surface 80E of the homing pin 80 can be close so that those elements engage one another precisely. The perimeter slot 44 can extend from a first side wall 45W1 of the base 45 to a second side wall 45W2 of the base 45. Optionally, the homing pin 80 can be configured so that it does not extend beyond the respective first and second side walls 45W1 and 45W2 of the base. Further optionally, the perimeter slot 44S can be of a depth D3 that is less than, or optionally about half the diameter D4 of the homing pin 80. Of course, the depth D3 can be less than half the diameter D4 of the homing pin 80.

As shown in FIG. 4, the homing pin 80 can be disposed within the perimeter slot 44S and can be held in place in the homing slot 70 by the adjustment control 90 as described below. The homing pin 80 also can be locked, secured or captured within the perimeter slot 44S via a capture fastener 86. This capture fastener 86 can include a capture fastener head 86H and a shaft 86S. This shaft 86 can be threaded and can be received in a threaded hole 860 defined by the base 45 and adjacent the perimeter slot 44S. The hole can be spaced so that the head 86H at least partially overlaps the second end 82 of the homing pin 80 by a distance D5. This distance D5 can be sufficient to capture the homing pin 80 and keep it from exiting the perimeter slot 44S. Optionally this distance D5 can be less than the diameter D4 of the homing pin 80.

As mentioned above, the adjuster 40 can include an adjustment control 90. This adjustment control 90 optionally can be operable in a lock mode, shown in FIG. 2, in which the adjustment control 90 engages the homing pin 80 with the homing slot 70 to prevent the elongated arm 60 from sliding within the round arm hole 42 or otherwise moving relative to the windage adjuster 40 and the base 45 thereof. The adjustment control 90 also can be operable in in adjustment mode, in which the adjustment control disengages the homing pin from the homing slot to allow the elongated arm to slide inward or outward relative to the base 45 and thereby adjust the distance D1 of the sight housing and the sight indicia relative to the mounting bracket and/or the archery bow riser to which the sight is mounted.

The adjustment control can include a knob 91 which can be grasped by a user and a threaded shaft 92 that can be disposed in a shaft hole 90O. The shaft hole 90O can be threaded as well. The shaft hole 90O can extend inward through the base 45 and can be transverse to the longitudinal axis LA of the round arm hole 42. The shaft hole 90O can be coextensive with and/or intersect the perimeter slot 44S as well as the round arm hole 42. Optionally, the shaft hole 90O can be disposed so that it intersects and/or points toward the homing pin 80 about midway between its ends, or in the middle of the pin length PL. When the threaded shaft 92 is threaded into the shaft hole, it can extend into the round armhole and/or the perimeter slot that is coextensive with the round armhole, and can engage and/or exert a force on the homing pin 80. As shown in FIG. 2, upon tightening the adjustment control 90, the end of the threaded shaft 92 can engage the homing pin 80 with a force F1 to push or press the homing pin 80 against the elongated arm and in particular into the homing slot 70. When this occurs, the force F1 is translated through the homing pin and to the elongated arm, to effectively clamp the elongated arm within the round arm hole, optionally between the homing pin 80 and the perimeter 44. Due to the registration of the homing pin in the homing slot, the elongated arm also is prevented from rotating, along with the associated sight housing and sight indicia.

Optionally, as the homing pin is forcibly engaged with the homing slot or generally the arm, the homing pin 80 is simultaneously disposed in the perimeter slot 44S and the homing slot 70. For example, a portion of the diameter D4 of the homing pin 80 can be disposed within the perimeter slot 44S and another portion thereof can be disposed in the homing slot 70.

As mentioned above, the adjustment control 90 also can be operable in an adjustment mode. In this adjustment mode, the force F1 is removed from the homing pin 80 so that it no longer forcibly engages the pin 80 within the slot 70. To adjust the distance D1 between the sight housing and the windage adjuster or mounting bracket, a user can rotate a dial 96, also referred to as a ring. This dial 96 can be threaded with threads 96T as shown in FIG. 4. The arm 60 also can include multiple threads 60T about its exterior 60E that interface with the threads 96T of the dial 96. By rotating the dial 96, that rotation translates to a linear motion K of the elongated arm 60 along the longitudinal axis LA. As a result, the sight housing 50 and indicia 52 can move laterally side to side relative to the windage adjuster and the mounting bracket in general. After the adjustment is made, the adjustment control can be returned to the lock mode to hold the sight housing and sight at a fixed distance D1 relative to the adjuster 40 and the mounting bracket 20. Of course, throughout all of this movement, the registration or indexing of the homing pin in the homing slot can prevent or impair any rotational movement in direction R shown in FIG. 2 about the longitudinal axis LA. Again, this maintains the consistent and precise orientation of the sight housing and sight indicia relative to the windage adjuster and mounting bracket throughout any adjustment. This consistent positioning is maintained when the adjuster is returned to the locked mode as well.

A method of using the archery sight 10 of the embodiment described above is also provided. The method generally can include providing a round elongated arm 60 joined with a sight housing 50 within which a sight indicia 55 is disposed, the round elongated arm being selectively slidably disposed in a round arm hole 42; and preventing the sight housing 50 from rotating relative to an adjuster 40 and a mounting bracket 20 configured to join with an archery bow, via interaction of a homing pin 80 registered simultaneously in a homing slot 70 and a perimeter slot 44S coextensive with the round arm hole. In particular, the homing pin 80 can be disposed in the homing slot 70. In a locked mode, the homing pin can be pressed within the homing slot to frictionally engage the homing pin with the homing slot and thus the arm in this mode. Optionally, the homing pin also can be simultaneously disposed in the perimeter slot 44S. Via this registration in the respective slots, the homing pin 80 can key the elongated arm to the round arm hole to prevent rotation of the arm relative to the hole and the base 45 of the adjuster 40 as described above. Again, the adjuster 40 can be controlled with the adjustment control 90 from a lock mode to an adjustment mode as described above to adjust the distance D1 of the sight housing 50 and the one or more sight pins 52 relative to the mounting bracket and other components of the archery bow to which the sight 10 is attached, as described above.

Optionally, the method can include rotating an adjustment control 90 so that a shaft disengages the homing pin 80, which in turn decreases a force F1 exerted by the homing pin within the homing slot 70. In this adjustment mode, the homing slot 70 is free to slide relative to the homing pin along with the round elongated arm 60, as well as the attached sight housing and sight indicia. A user can subsequently operate the adjustment control to a lock mode, and secure the sight housing at a fixed distance D1 relative to the adjuster and mounting bracket.

Although the different elements and assemblies of the embodiments are described herein as having certain functional characteristics, each element and/or its relation to other elements can be depicted or oriented in a variety of different aesthetic configurations, which support the ornamental and aesthetic aspects of the same. Simply because an apparatus, element or assembly of one or more of elements is described herein as having a function does not mean its orientation, layout or configuration is not purely aesthetic and ornamental in nature.

Directional terms, such as "vertical," "horizontal," "top," "bottom," "upper," "lower," "inner," "inwardly," "outer" and "outwardly," are used to assist in describing the invention based on the orientation of the embodiments shown in the illustrations. The use of directional terms should not be interpreted to limit the invention to any specific orientation(s).

In addition, when a component, part or layer is referred to as being "joined with," "on," "engaged with," "adhered to," "secured to," or "coupled to" another component, part or layer, it may be directly joined with, on, engaged with, adhered to, secured to, or coupled to the other component, part or layer, or any number of intervening components, parts or layers may be present. In contrast, when an element is referred to as being "directly joined with," "directly on," "directly engaged with," "directly adhered to," "directly secured to," or "directly coupled to" another element or layer, there may be no intervening elements or layers present. Other words used to describe the relationship between components, layers and parts should be interpreted in a like manner, such as "adjacent" versus "directly adjacent" and similar words. As used herein, the term "and/or" includes any and all combinations of one or more of the associated listed items.

The above description is that of current embodiments of the invention. Various alterations and changes can be made without departing from the broader aspects of the invention as defined in the appended claims, which are to be interpreted in accordance with the principles of patent law including the doctrine of equivalents. This disclosure is presented for illustrative purposes and should not be interpreted as an exhaustive description of all embodiments of the invention or to limit the scope of the claims to the specific elements illustrated or described in connection with these embodiments. For example, and without limitation, any individual element(s) of the described invention may be replaced by alternative elements that provide substantially similar functionality or otherwise provide adequate operation. This includes, for example, presently known alternative elements, such as those that might be currently known to one skilled in the art, and alternative elements that may be developed in the future, such as those that one skilled in the art might, upon development, recognize as an alternative. Further, the disclosed embodiments include a plurality of features that are described in concert and that might cooperatively provide a collection of benefits. The present invention is not limited to only those embodiments that include all of these features or that provide all of the stated benefits, except to the extent otherwise expressly set forth in the issued claims. Any reference to claim elements in the singular, for example, using the articles "a," "an," "the" or "said," is not to be construed as limiting the element to the singular. Any reference to claim elements as "at least one of X, Y and Z" is meant to include any one of X, Y or Z individually, any combination of X, Y and Z, for example, X, Y, Z; X, Y; X, Z; Y, Z, and/or any other possible combination together or alone of those elements, noting that the same is open ended and can include other elements.

What is claimed is:

1. An archery bow sight comprising:

a mounting bracket including a proximal end and a distal end, the proximal end configured to mount to an archery bow riser, the distal end projecting forwardly of the proximal end;

a windage adjuster including an adjuster base joined with the distal end of the mounting bracket and an elongated arm selectively slidable within a cylindrical arm hole defined by the adjuster base, the elongated arm including a first end and a second end, a longitudinal axis extending therebetween, with an intermediate portion disposed between the first end and the second end, the second end being laterally moveable relative to the mounting bracket when the elongated arm selectively slides relative to the cylindrical arm hole in a direction parallel to the longitudinal axis, the elongated arm being cylindrical and defining a homing slot extending within the intermediate portion and aligned with the longitudinal axis;

a homing pin indexed within the homing slot and aligned with the longitudinal axis;

a sight housing joined with the second end of the elongated arm, distal from the mounting bracket; and a sight pin disposed in the housing and visible to a user, wherein the homing pin indexed within the homing slot prevents the sight housing from free spinning with the elongated arm in the cylindrical arm hole about the longitudinal axis, wherein the cylindrical elongated arm slides within the cylindrical arm hole of the adjuster base so that the sight housing moves toward or away from the windage adjuster, wherein the cylindrical arm hole is coextensive with a perimeter slot defined by the adjuster base, the homing pin being received simultaneously in the perimeter slot and in the homing slot, wherein the homing pin is maintained in the perimeter slot with at least one of a capture fastener at last partially overlapping the homing pin and an adjustment control with a threaded shaft that presses the homing pin in the homing slot with the homing pin remaining stationary relative to the perimeter slot when the elongated arm slides in the cylindrical arm hole of the adjuster base.

2. An archery bow sight comprising:

a mounting bracket including a proximal end and a distal end, the proximal end configured to mount to an archery bow riser, the distal end projecting forwardly of the proximal end;

a windage adjuster joined with the distal end, the windage adjuster including an elongated arm selectively slidable within a round arm hole defined by the windage adjuster, the elongated arm including a first end and a second end, a longitudinal axis extending therebetween, with an intermediate portion disposed between the first end and the second end, the second end being laterally moveable relative to the mounting bracket when the elongated arm selectively slides relative to the round arm hole in a direction parallel to the longitudinal axis, the elongated arm defining a homing slot extending within the intermediate portion and aligned with the longitudinal axis;

a homing pin indexed within the homing slot and aligned with the longitudinal axis;

a sight housing joined with the second end of the elongated arm, distal from the mounting bracket;

a sight pin disposed in the housing and visible to a user, wherein the homing pin indexed within the homing slot prevents the sight housing from free spinning with the elongated arm in the round arm hole about the longitudinal axis; and an adjustment control extending through a portion of the windage adjuster and operable in a lock mode, in which the adjustment control engages the homing pin with the homing slot to prevent the elongated arm from sliding within the round arm hole.

3. The archery bow sight of claim 2, wherein the round arm hole is bounded by a perimeter, wherein the adjustment control includes a knob and a threaded shaft, wherein the perimeter defines a shaft hole that is transverse to the round arm hole, wherein the threaded shaft projects through the shaft hole and engages the homing pin in the lock mode, such that the homing pin presses against the elongated arm within the homing slot.

4. The archery bow sight of claim 1, wherein the homing pin includes a homing pin length, wherein the homing slot includes a homing slot length, wherein the homing pin length is less than the homing slot length.

5. The archery bow sight of claim 1, wherein the homing pin is simultaneously disposed in the perimeter slot and the homing slot, wherein the adjuster base includes a first sidewall and an opposing second sidewall, wherein the homing pin does not extend beyond the first sidewall and the second sidewall.

6. The archery bow sight of claim 1, wherein the elongated arm is threaded along at least the intermediate portion, wherein the windage adjuster includes a dial that threadably engages the intermediate portion, wherein rotation of the dial slides the elongated arm relative to the cylindrical arm hole to move the sight housing toward or away from the windage adjuster.

7. The archery bow sight of claim 6, wherein the cylindrical arm hole is bounded by a perimeter, wherein the perimeter is continuous around the elongated arm.

8. An archery bow sight comprising:

a mounting bracket including a proximal end and a distal end, the proximal end configured to mount to an archery bow riser, the distal end projecting forwardly of the proximal end;

a windage adjuster joined with the distal end, the windage adjuster including an elongated arm selectively slidable within a round arm hole defined by the windage adjuster, the elongated arm including a first end and a second end, a longitudinal axis extending therebetween, with an intermediate portion disposed between the first end and the second end, the second end being laterally moveable relative to the mounting bracket when the elongated arm selectively slides relative to the round arm hole in a direction parallel to the longitudinal axis, the elongated arm defining a homing slot extending within the intermediate portion and aligned with the longitudinal axis;

a homing pin indexed within the homing slot and aligned with the longitudinal axis;

a sight housing joined with the second end of the elongated arm, distal from the mounting bracket;

a sight pin disposed in the housing and visible to a user, wherein the homing pin indexed within the homing slot prevents the sight housing from free spinning with the elongated arm in the round arm hole about the longitudinal axis wherein the round arm hole is bounded by a perimeter, wherein the elongated arm is cylindrical and threaded along at least the intermediate portion, wherein the windage adjuster includes a dial that threadably engages the intermediate portion, wherein rotation of the dial slides the elongated arm relative to the round arm hole to move the sight housing toward or away from the windage adjuster, wherein the perimeter is continuous around the elongated arm, wherein a perimeter slot is defined by the perimeter and the homing pin is simultaneously registered in the perimeter slot and the homing slot, and the homing pin is maintained in the perimeter slot with a capture fastener having a head that overlaps the perimeter slot.

9. An archery bow sight comprising:

a mounting bracket including a proximal end and a distal end, the proximal end configured to mount to an archery bow riser, the distal end projecting forwardly of the proximal end;

a windage adjuster joined with the distal end, the windage adjuster including an elongated arm selectively slidable within a round arm hole defined by the windage adjuster, the elongated arm including a first end and a second end, a longitudinal axis extending therebetween, with an intermediate portion disposed between the first end and the second end, the second end being laterally moveable relative to the mounting bracket when the elongated arm selectively slides relative to the round arm hole in a direction parallel to the longitudinal axis, the elongated arm defining a homing slot extending within the intermediate portion and aligned with the longitudinal axis;

a homing pin indexed within the homing slot and aligned with the longitudinal axis;

a sight housing joined with the second end of the elongated arm, distal from the mounting bracket;

a sight pin disposed in the housing and visible to a user; and an adjustment control including a threaded shaft that presses the homing pin in the homing slot, wherein the homing pin indexed within the homing slot prevents the sight housing from free spinning with the elongated arm in the round arm hole about the longitudinal axis.

10. The archery bow sight of claim 9, wherein the windage adjuster includes a fastener that threads to the mounting block to join the windage adjuster with the mounting block, wherein the windage adjuster includes an indicia window that is coextensive with the cylindrical arm hole, wherein the elongate arm includes indicia visible through the windage adjuster via the indicia window.

11. An archery bow sight comprising:

a mounting bracket configured to mount to an archery bow;

an adjuster joined with the mounting bracket, the adjuster including an adjuster base, the adjuster base defining a cylindrical arm hole, the adjuster including a cylindrical elongated arm selectively slidable in and directly engaging the cylindrical arm hole of the adjuster base, the adjuster base defining a perimeter slot coextensive with the cylindrical arm hole;

a sight housing joined with the cylindrical elongated arm, distal from the mounting bracket;

a sight indicia disposed in the housing and visible to a user; and a homing pin indexed within a homing slot to prevent the sight housing from free spinning with the cylindrical elongated arm in the cylindrical arm hole about a longitudinal axis when the adjuster is operated by a user to move the sight housing relative to the mounting bracket, wherein the homing pin engages the adjuster base and the homing slot simultaneously to prevent the sight housing from free spinning about the longitudinal axis, wherein the homing slot is defined by the cylindrical elongated arm, wherein the homing pin is registered in the homing slot, wherein an adjustment control having a shaft is threadable in the adjuster base and configured to press the homing pin in the homing slot to clamp the cylindrical elongated arm in the cylindrical arm hole.

12. The archery bow sight of claim 11 comprising: wherein the shaft extends within a shaft hole defined by the adjuster base and engages the homing pin in a lock mode, such that the homing pin presses against the cylindrical elongated arm within the homing slot so that the cylindrical elongated arm is prevented from sliding relative to the cylindrical arm hole in the lock mode.

13. The archery bow sight of claim 12, wherein the shaft is threaded, wherein the shaft hole is threaded, wherein the shaft is joined with a manual adjustment knob, wherein rotation of the manual adjustment knob advances an end of the shaft to press against the homing pin, pressing the homing pin within the homing slot, to frictionally engage the homing pin with the homing slot in the lock mode.

14. An archery bow sight comprising:

a mounting bracket configured to mount to an archery bow;

an adjuster joined with the bracket, the adjuster including an adjuster base defining a round arm hole and including a round elongated arm selectively slidable in the round arm hole and having a longitudinally extending homing slot;

a sight housing joined with the round elongated arm, distal from the mounting bracket;

a sight indicia disposed in the housing and visible to a user;

a homing pin indexed within the homing slot to prevent the sight housing from free spinning with the round elongated arm in the round arm hole about a longitudinal axis when the adjuster is operated by a user to move the sight housing relative to the mounting bracket; and a perimeter slot coextensive with the round arm hole, wherein the homing pin is simultaneously registered in the perimeter slot and the homing slot, a capture fastener that overlaps the perimeter slot so that the homing pin is trapped in the perimeter slot.

15. An archery bow sight comprising:

a mounting bracket configured to mount to an archery bow;

an adjuster joined with the bracket, the adjuster including an adjuster base defining a round arm hole and including a round elongated arm selectively slidable in the round arm hole;

a sight housing joined with the round elongated arm, distal from the mounting bracket;

a sight indicia disposed in the housing and visible to a user; and a homing pin indexed within a homing slot in the elongated arm to prevent the sight housing from free spinning with the round elongated arm in the round arm hole about a longitudinal axis when the adjuster is operated by a user to move the sight housing relative to the mounting bracket, at least one of a capture fastener overlapping the homing pin and a threaded shaft of an adjustment control pressing the homing pin in the homing slot disposed adjacent the adjuster base, wherein the adjuster is a windage adjuster, wherein the round elongated arm is cylindrical and includes threads, wherein the adjuster includes a dial that threadably engages the threads, wherein rotation of the dial slides the round elongated arm within the round arm hole so that the sight housing moves toward or away from the adjuster, wherein the homing pin slides in the homing slot as the sight housing moves, wherein the adjuster base defines a perimeter slot coextensive with the round arm hole, wherein at least one of the capture fastener and the adjustment control maintains the homing pin in the perimeter slot.

16. An archery bow sight comprising:

a mounting bracket configured to mount to an archery bow;

an adjuster joined with the bracket, the adjuster including an adjuster base defining a round arm hole and including a round elongated arm selectively slidable in the round arm hole;

a sight housing joined with the round elongated arm, distal from the mounting bracket;

a sight indicia disposed in the housing and visible to a user;

a homing pin indexed within a homing slot in the elongated arm to prevent the sight housing from free spinning with the round elongated arm in the round arm hole about a longitudinal axis when the adjuster is operated by a user to move the sight housing relative to the mounting bracket; and a perimeter slot coextensive with the round arm hole and defined by the adjuster base, the homing pin being received simultaneously in the homing slot and the perimeter slot, the homing pin being maintained in the perimeter slot by at least one of a capture fastener overlapping the homing pin and a threaded shaft of an adjustment control pressing the homing pin in the homing slot, wherein the homing pin remains stationary relative to the perimeter slot as the homing pin slides in the homing slot.

17. A method of using an archery bow sight, the method comprising:

providing a round elongated arm joined with a sight housing within which a sight indicia is disposed, the round elongated arm being selectively slidably disposed in a round arm hole; and preventing the sight housing from rotating relative to an adjuster and a mounting bracket configured to join with an archery bow, via interaction of a homing pin registered simultaneously in a homing slot and a perimeter slot coextensive with the round arm hole; and rotating an adjustment control so that a shaft disengages the homing pin, which in turn decreases a force exerted by the homing pin within the homing slot, so that the homing slot is free to slide relative to the homing pin along with the round elongated arm.

* * * * *